US010113264B2

(12) United States Patent
Hollis

(10) Patent No.: US 10,113,264 B2
(45) Date of Patent: Oct. 30, 2018

(54) DEVICE ADAPTED TO MAINTAIN FORM AND ASSIST IN DRYING OF A GLOVE

(71) Applicant: Adam Hollis, Thompson Station, TN (US)

(72) Inventor: Adam Hollis, Thompson Station, TN (US)

( * ) Notice: Subject to any disclaimer, the term of this patent is extended or adjusted under 35 U.S.C. 154(b) by 0 days.

(21) Appl. No.: 15/496,195

(22) Filed: Apr. 25, 2017

(65) Prior Publication Data

US 2017/0314182 A1 Nov. 2, 2017

Related U.S. Application Data

(60) Provisional application No. 62/329,332, filed on Apr. 29, 2016.

(51) Int. Cl.

| | |
|---|---|
| ***D06F 59/04*** | (2006.01) |
| *F26B 21/00* | (2006.01) |
| *F26B 9/00* | (2006.01) |

(52) U.S. Cl.

CPC ..... *D06F 59/04* (2013.01); *F26B 9/00* (2013.01); *F26B 21/00* (2013.01)

(58) Field of Classification Search

CPC .... D06F 9/00; D06F 9/04; F26B 21/00; F26B 9/00; A41D 1/00; A41D 19/00; A41D 2600/10; A47F 7/00; A47F 7/19; A47F 8/00; A47G 25/02; A47G 25/904

USPC ..... D32/8; D2/641

See application file for complete search history.

(56) References Cited

U.S. PATENT DOCUMENTS

| | | | |
|---|---|---|---|
| 42,111 | A | 3/1864 | Reed |
| 550,470 | A | 11/1895 | Anthony |
| D25,538 | S | 5/1896 | Paeabody |
| 686,884 | A | 11/1901 | Becker |
| 726,666 | A | 4/1903 | Foulds |
| 761,856 | A | 6/1904 | Smail |
| 763,406 | A | 6/1904 | Krell |
| 795,706 | A | 7/1905 | Kirbach |
| 818,178 | A | 4/1906 | Lane |
| 907,137 | A | 12/1908 | Fsnohr |
| 915,465 | A | 3/1909 | McBride |

(Continued)

OTHER PUBLICATIONS

Wire, Fine and Extra Fine Wire, available at: http://giovannaimperia,com/metal/wire.html.

*Primary Examiner* — Ismael Izaguirre

(74) *Attorney, Agent, or Firm* — Thomas A. O'Rourke; Bodner + O'Rourke, LLP

(57) ABSTRACT

An insert maintains the form of a glove while facilitating drying. The insert has palm, finger, and thumb portions. The palm portion is a planar or curved flange, having first and second sides. The finger portion includes an index finger flange, a middle finger flange, a ring finger flange, and a pinky finger flange, each extending from the palm portion. A first peripheral flange and a second peripheral flange are each configured to respectively extend away from, and be in continuous proximity to, a periphery formed by the first side and the second side of the palm portion and the finger flanges. First and second transverse flanges are formed for each of the finger flanges, each configured to extend away from first and second sides thereof, and be substantially centered on the finger flange, to provide eight radiused points of a contact/support being substantially equally spaced, for each glove finger.

9 Claims, 9 Drawing Sheets

(56) References Cited

U.S. PATENT DOCUMENTS

| | | | | | |
|---|---|---|---|---|---|
| 1,038,596 | A | | 9/1912 | Kellogg | |
| 1,102,224 | A | | 6/1914 | Carron | |
| 1,173,955 | A | | 2/1916 | Grueber | |
| 1,174,455 | A | | 3/1916 | Von Stetten | |
| 1,184,954 | A | | 5/1916 | Hoffman | |
| 1,215,158 | A | | 2/1917 | Isaacs | |
| 1,221,165 | A | | 4/1917 | Gillam | |
| 1,292,240 | A | | 1/1919 | Braun | |
| 1,319,579 | A | | 10/1919 | Gillam | |
| 1,425,969 | A | | 8/1922 | Johnson | |
| 1,543,829 | A | | 6/1925 | Doyle | |
| 1,568,078 | A | | 1/1926 | Mabey | |
| 1,733,680 | A | | 10/1929 | Turner | |
| 1,736,679 | A | | 11/1929 | Tierney | |
| 1,755,605 | A | | 4/1930 | Knox | |
| 1,755,902 | A | | 4/1930 | Tascarella | |
| 1,997,921 | A | | 4/1935 | Bliss | |
| 2,035,094 | A | | 3/1936 | Palicki | |
| 2,261,225 | A | * | 11/1941 | Cissell | D06F 59/06 223/75 |
| 2,281,741 | A | | 5/1942 | Boulard | |
| 2,426,331 | A | | 8/1947 | Ziskind | |
| 2,426,632 | A | | 2/1949 | Givoni | |
| 2,511,456 | A | | 6/1950 | Boldizzonl | |
| 2,524,285 | A | | 10/1950 | Chezurn | |
| 2,565,455 | A | | 8/1951 | Miller | |
| 2,747,227 | A | | 5/1956 | Reuter | |
| 2,783,925 | A | | 3/1957 | Ross | |
| 2,959,331 | A | | 11/1960 | Boidizzoni | |
| D193,408 | S | * | 8/1962 | Goldman | D32/59 |
| D195,137 | S | | 4/1963 | Jennings | |
| 3,096,008 | A | | 7/1963 | Schumacher | |
| 3,133,682 | A | | 5/1964 | Sawyer | |
| 3,159,504 | A | | 12/1964 | Sarjanian | |
| 3,255,492 | A | | 6/1966 | Velonis | |
| 3,363,284 | A | | 1/1968 | Bille | |
| 3,409,142 | A | | 11/1968 | Mechaneck | |
| 3,477,622 | A | | 11/1969 | Appelt | |
| 3,486,670 | A | | 12/1969 | Sutton | |
| 3,513,564 | A | | 5/1970 | Gramprie | |
| 3,798,788 | A | | 3/1974 | Kuntz | |
| 3,917,266 | A | | 11/1975 | Kiey | |
| D243,313 | S | | 2/1977 | Varnado | |
| 4,018,382 | A | | 4/1977 | DiCuya | |
| 4,084,733 | A | | 4/1978 | Perlmutter | |
| 4,145,602 | A | | 3/1979 | Lee | |
| 4,199,089 | A | | 4/1980 | Filkow | |
| 4,209,913 | A | | 7/1980 | Wallin | |
| 4,638,915 | A | | 1/1987 | Kaplan | |
| 4,689,897 | A | | 9/1987 | Marsalona | |
| 4,697,724 | A | | 10/1987 | Pitcher | |
| 5,011,053 | A | | 4/1991 | Davies | |
| D322,344 | S | | 12/1991 | Winkler | |
| 5,117,565 | A | | 6/1992 | Willenbacher | |
| 5,125,169 | A | | 6/1992 | Bader | |
| 5,234,141 | A | | 8/1993 | Spiece | |
| 5,379,525 | A | | 1/1995 | Raynor | |
| 5,406,717 | A | | 4/1995 | Dofka | |
| 5,604,993 | A | | 2/1997 | Auckerman | |
| 5,692,316 | A | | 12/1997 | Antal | |
| D391,720 | S | | 3/1998 | Schoenewolf | |
| 5,913,461 | A | | 6/1999 | Boudreau | |
| 5,983,518 | A | | 11/1999 | Ellenburg | |
| 6,076,713 | A | | 6/2000 | Boudreau | |
| 6,085,436 | A | | 7/2000 | Peet | |
| 6,098,853 | A | | 8/2000 | Beitz | |
| 6,766,594 | B2 | | 7/2004 | DuRapau | |
| 6,942,107 | B2 | | 9/2005 | Neubert | |
| D544,670 | S | | 6/2007 | Sorvill | |
| D563,070 | S | | 2/2008 | Palese | |
| D585,169 | S | | 1/2009 | Barzegar | |
| 7,716,849 | B1 | | 5/2010 | Hicks | |
| 7,770,723 | B2 | | 8/2010 | Hajduk | |
| D655,878 | S | * | 3/2012 | Hajduk | D06F 59/04 D32/59 |
| 8,869,423 | B2 | | 10/2014 | Nicholson | |
| 9,033,195 | B1 | | 5/2015 | Martinez-Ramos | |
| D761,517 | S | * | 7/2016 | Dugger | D2/641 |
| 9,512,556 | B1 | | 12/2016 | Kazravan | |
| 2004/0181963 | A1 | | 9/2004 | Morris | |
| 2008/0083131 | A1 | | 4/2008 | Wess | |
| 2013/0212900 | A1 | | 8/2013 | Stewart | |

* cited by examiner

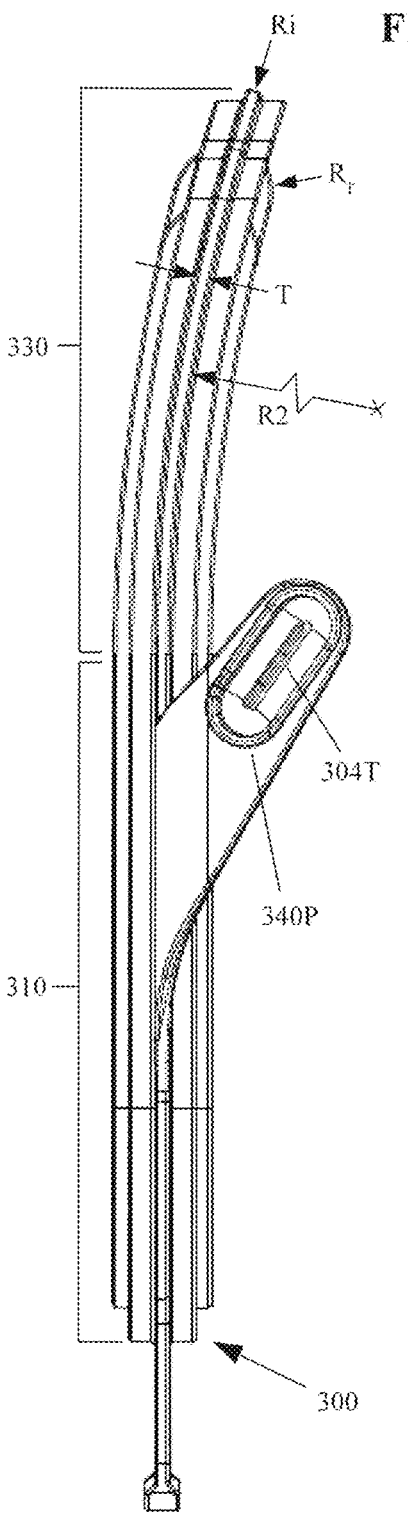
FIG. 8
FIG. 7A
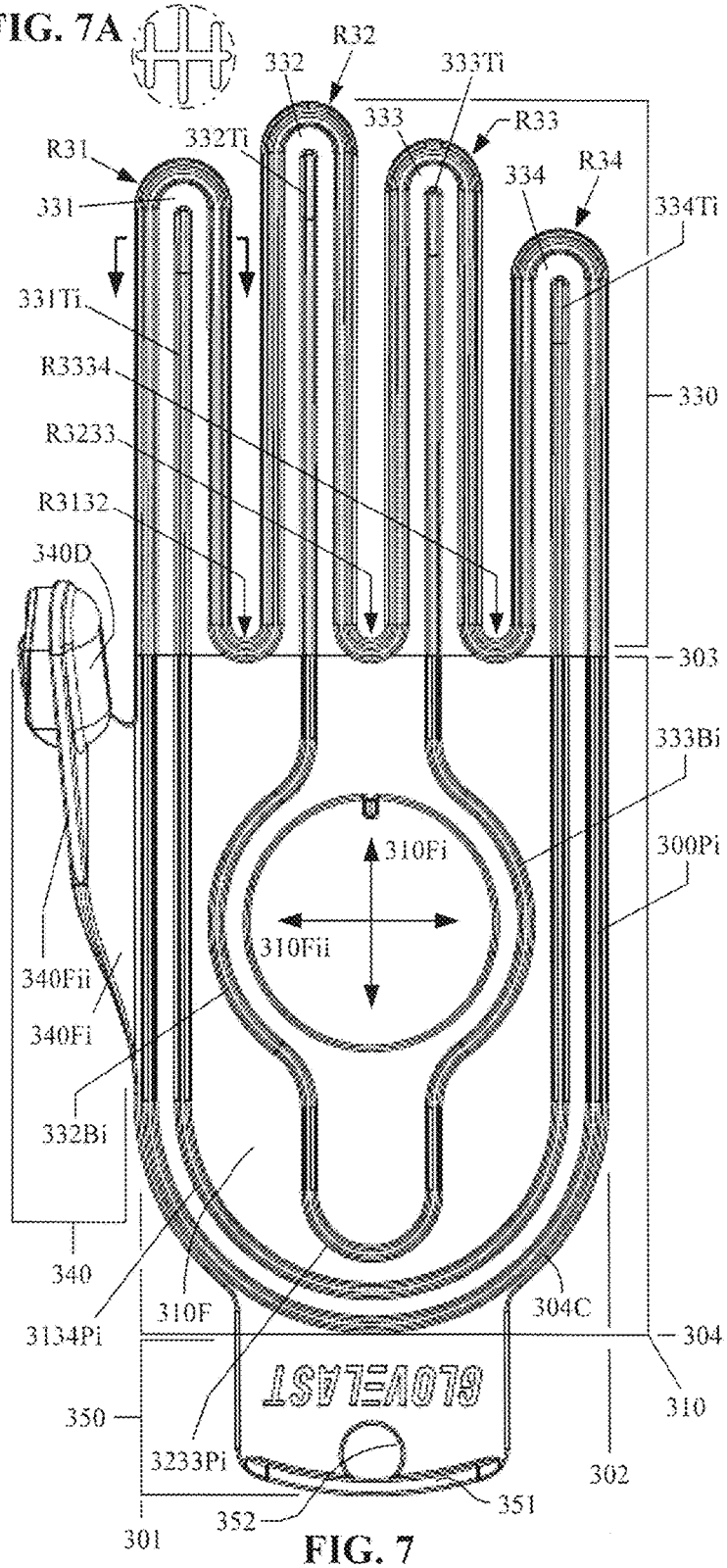
FIG. 7

DEVICE ADAPTED TO MAINTAIN FORM AND ASSIST IN DRYING OF A GLOVE

CROSS REFERENCES TO RELATED APPLICATIONS

This application claims priority on U.S. Provisional Application Ser. No. 62/329,332, filed on Apr. 29, 2016, the disclosures of which are incorporated herein by reference.

FIELD OF THE INVENTION

The present invention relates to an insert for use in supporting an interior surface of a glove, to maintain its form, particularly when it is desirable to also dry out the glove.

BACKGROUND OF THE INVENTION

The use of a device and/or an insert to assist in the drying of a glove and/or for generally maintaining the shape of the glove is known in the art. Glove inserts and glove drying devices are shown, for example, by U.S. Pat. Nos. D25,538 to Peabody; 686,884 to Becker; 795,706 to Kirbach; 1,319,579 to Gillam; 2,462,632 to Givoni; 2,783,925 to Ross; 3,133,682 to Sawyer; 3,486,670 to Sutton; 3,917,266 to Kiey; 4,018,382 to DiCuya; 4,084,733 to Perimutter; 4,689,897 to Marsalona; 5,125,169 to Bader; and 5,913,461 to Boudreau.

Although the use of such devices is highly desirable for winter gloves, particularly those used by skiers and other winter sports participants, it is also very advantageous for golfers with respect to a golf glove that has been worn throughout a long day of golfing. Golf gloves are typically made of leather, because it provides a great feel for the player's hand, and it provides a good grip on the club handle. Although leather tends to be moisture resistant, it will nonetheless hold water (e.g., perspiration and rain) when exposed for a substantial period of time, such as the time needed to play an 18-hole round of golf. It is therefore recommended to not only dry out the glove after use, but also to make sure it is not crumpled, which typically occurs when the glove is stuffed into a pocket of the golfer's golf bag after a round of golf.

The present invention provides improvements over the prior art devices for maintaining the form of a glove, particularly for when it must be dried out after use.

OBJECTS OF THE INVENTION

It is an object of the invention to provide a device that may be used to receive a glove thereon and provide substantially complete three-dimensional support for the shape of the glove, including each of its fingers and the palm/wrist region.

It is another object of the invention to provide a device that may assist in the drying of a glove after use, and to simultaneously aid in maintaining its desired form.

It is a further object of the invention to provide a device that may serve to support the glove into a form that is comparable to when it is being worn b the user.

It is another object of the invention to provide a device that is flexible and may deform, to permit easy insertion into and removal from the interior of a glove.

It is also an object of the invention to provide a device to aid in shaping and drying of a glove that may furthermore be configured to receive a disposable insert/packet that contains a desiccant, to accelerate drying of the glove.

It is another object of the invention to provide a device that may be particularly shaped and selectively coated in order to be easily inserted into a glove, and therein maintain its form while drying out.

Further objects and advantages of the invention will become apparent from the following description and claims, and from the accompanying drawings.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In accordance with at least one embodiment of the present invention, an insert may be formed to receive a glove thereon, to provide substantially complete three-dimensional support to the interior of the glove to maintain its preferred shape, including each of its fingers and the palm/wrist region. The glove insert may assist in more rapid and more thorough drying of a glove after use, while simultaneously assisting in maintaining its desired form, which may be the form that is comparable to when it is being worn by the relaxed open hand of a user for which it is sized. It is noted that use of the word "finger" or "fingers" herein may refer to the index finger, the middle finger, the ring finger, the pinky, and the thumb as well, unless the, context specifically dictates that use of the word "fingers" is intended to exclude the thumb.

The glove insert may be used for any type of glove, including work gloves, ski gloves, baseball, or softball batting gloves, golf gloves, etc. For batting, and particularly for golf gloves, the sizing of the glove with respect to the golfer's hand is very important. Therefore, the insert, which normally may be provided in each of a small, a medium, and a large size, for both left and right hands, may instead be provided in corresponding sizes to which such golf gloves are sold, which usually includes small, medium, medium-large, large, extra-large and double extra-large sizes, in both the regular and cadet categories.

The glove insert may be formed to include a collar portion and a hand portion. The collar portion may be hollow, and may resemble the person's wrist, while the hand portion, which may extend therefrom, may generally form a complete three-dimensional shape resembling the proper size for the open hand. The fingers of the open hand portion may be spaced apart to provide clearance therebetween. The hand portion may also be hollow, and may be made of a thin wall, or of a wall of a suitable thickness to provide adequate support for the fingers to accommodate its insertion into the fingers of the glove. The glove insert may also be formed of a flexible material, and may deform, to permit easy insertion into and removal from the interior of a glove.

To be effective at aiding in drying of the glove while also maintaining its proper shape, the glove insert may be formed with a plurality of openings throughout the entire surface of the hand portion, which openings may preferably be formed in a regularly spaced pattern. The openings may be formed using any suitable shape.

To place the glove onto the insert, the user may simply grasp and compress the fingers of the flexible insert, and slide the gathered fingers into the open end of glove, with its flap detached. The fingers of the flexible insert, once released by the person, will naturally tend to spread out within the golf glove, and may then be advanced forward such that each finger of the insert may be directed to the corresponding finger opening of the glove.

BRIEF DESCRIPTION OF THE DRAWINGS

The description of the various example embodiments is explained in conjunction with appended drawings, in which.

Figure 9:
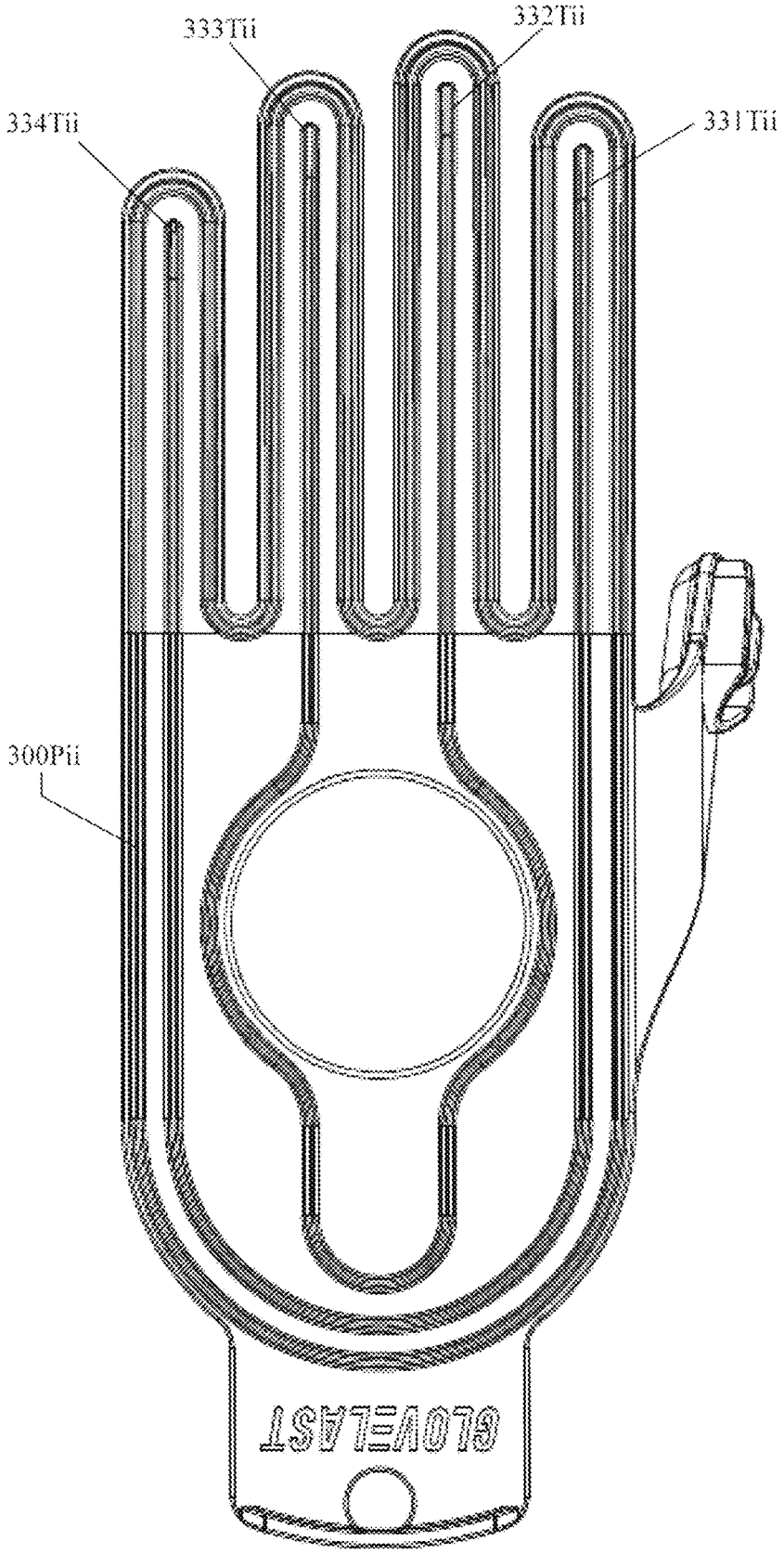
Figure 10:
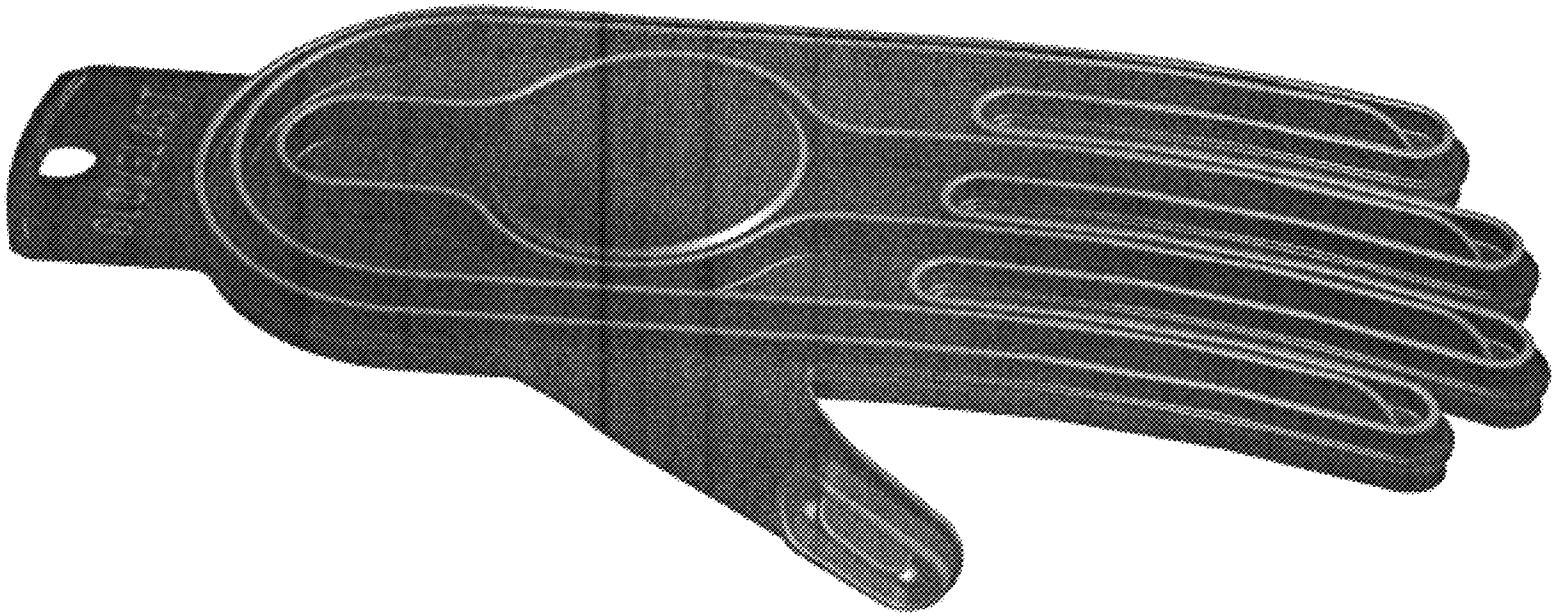
Figure 11:
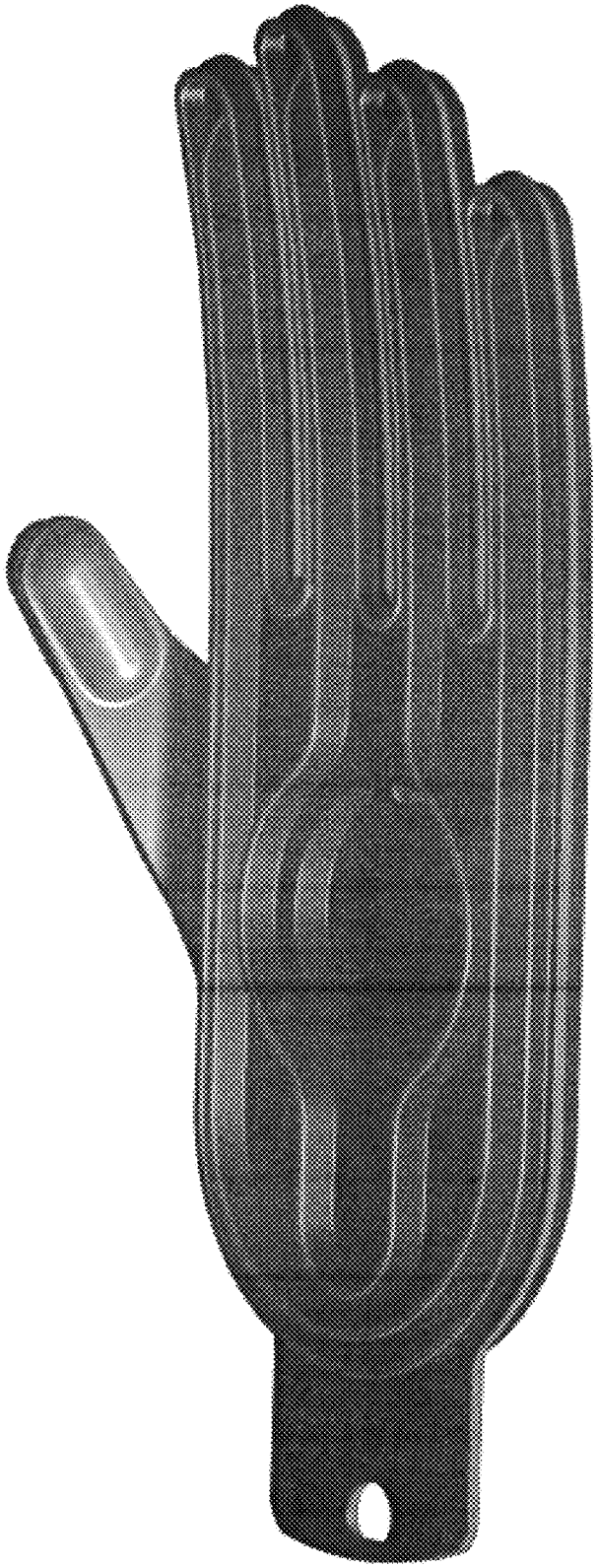

FIG, 7B is the cross-sectional view of FIG. 7A, but is shown enlarged;

FIG. 8 illustrates a side view of the glove device of FIG. 7;

FIG. 9 illustrates a rear view of the glove device of FIG. 7;

FIG. 10 is a perspective view of the front of the glove device of FIGS. 7; and FIG. 11 is a perspective view of the rear of the glove device of FIG. 7.

DETAILED DESCRIPTION OF THE INVENTION

As used throughout this specification, the word "may" is used in permissive sense (i.e., meaning having the potential to), rather than the mandatory sense (i.e., meaning must). Similarly, the words "include", "including" and "includes" mean including but not limited to.

The phrases "at least one", "one or more", and "and/or" are open-ended expressions that are both conjunctive and disjunctive in operation. For example, each of the expressions "at least one of A, B and C", "one or more of A, B, and C", and "A, B, and/or C" mean all of the following possible combinations: A alone; or B alone; or C alone; or A and B together; or A and C together; or B and C together; or A, B and C together.

Also, all references (e.g., patents, patent publications, and non-patent literature) that are cited within this documents are incorporated herein in their entirety by reference.

Furthermore, the described features, advantages, and characteristics of any particular embodiment disclosed in the following specification, may be combined in any suitable manner with any of the other embodiments disclosed herein.

Figure 1:
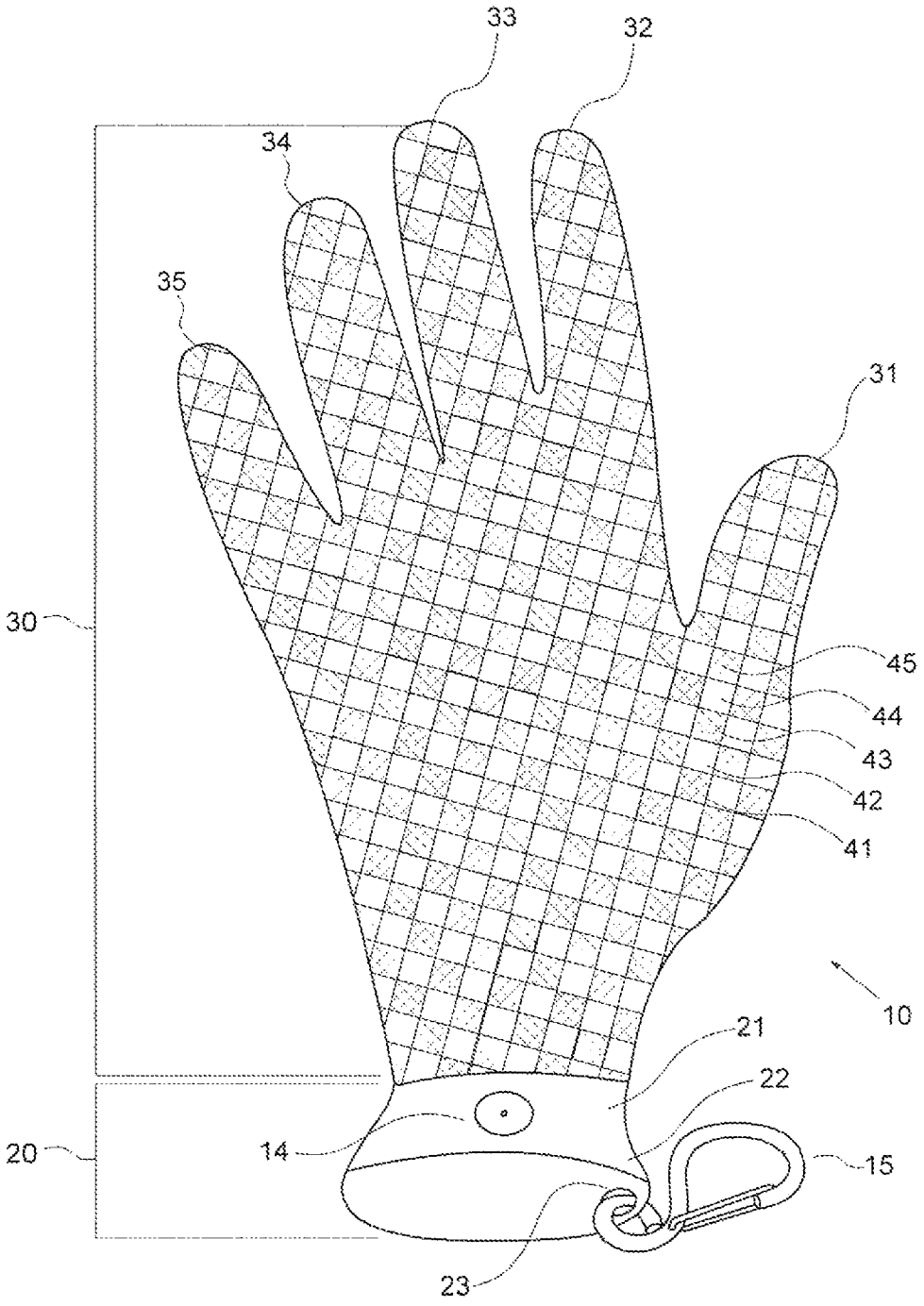
FIG. 1A illustrates a typical prior art golf glove.
FIG. 1B illustrates prior art golf bag, which includes a shoulder strap and pocket.

FIG. 1A shows a typical golf glove 100 that may be worn by a person while using one or more clubs for playing the game of golf. The typical glove 100 has a slit down its back to permit widening of the opening for easy placement onto the golfer's hand, which may be secured thereon using a flap that may maintain the two sides of the glove at the slit in proximity to each other using hook and loop materials (i.e., Velcro®) on the flap and on one side of the slit, as shown therein. FIG. 1B illustrates a common golf bag 201 for carrying around the player's golf clubs, which typically has one or more pockets 202 for storing of golf balls, a golf glove, and other articles therein.

Once a golfer has finished playing a round of golf, he/she typically removes their golf shoes, and also removes their golf glove 100 and ordinarily places the glove in the pocket (e.g., pocket 202) of their golf bag 201. The golf bag 201 is normally transported home in the trunk of the golfer's car, and then stored in a recreation room, or a garage, or a basement, etc. When the golf glove 100, which is typically moisture laden from perspiration from the round of golf, remains crumpled and stored in the pocket 202 of the golf bag 201, it will dry out that way and usually will become stiff and deformed, and may also become moldy. The present invention is directed to providing an improved apparatus and method of drying and storing a glove, and which also more easily enables the user to apply leather conditioner to the entire exterior surface of the glove once dried.

The present invention may also be used for drying and storing of baseball or softball batting gloves, ski gloves, work gloves, etc. Therefore, use herein of the term "glove" or "golf glove" is not intended to limit the applicability of the present invention with respect to its use for other types of gloves.

Figure 2:
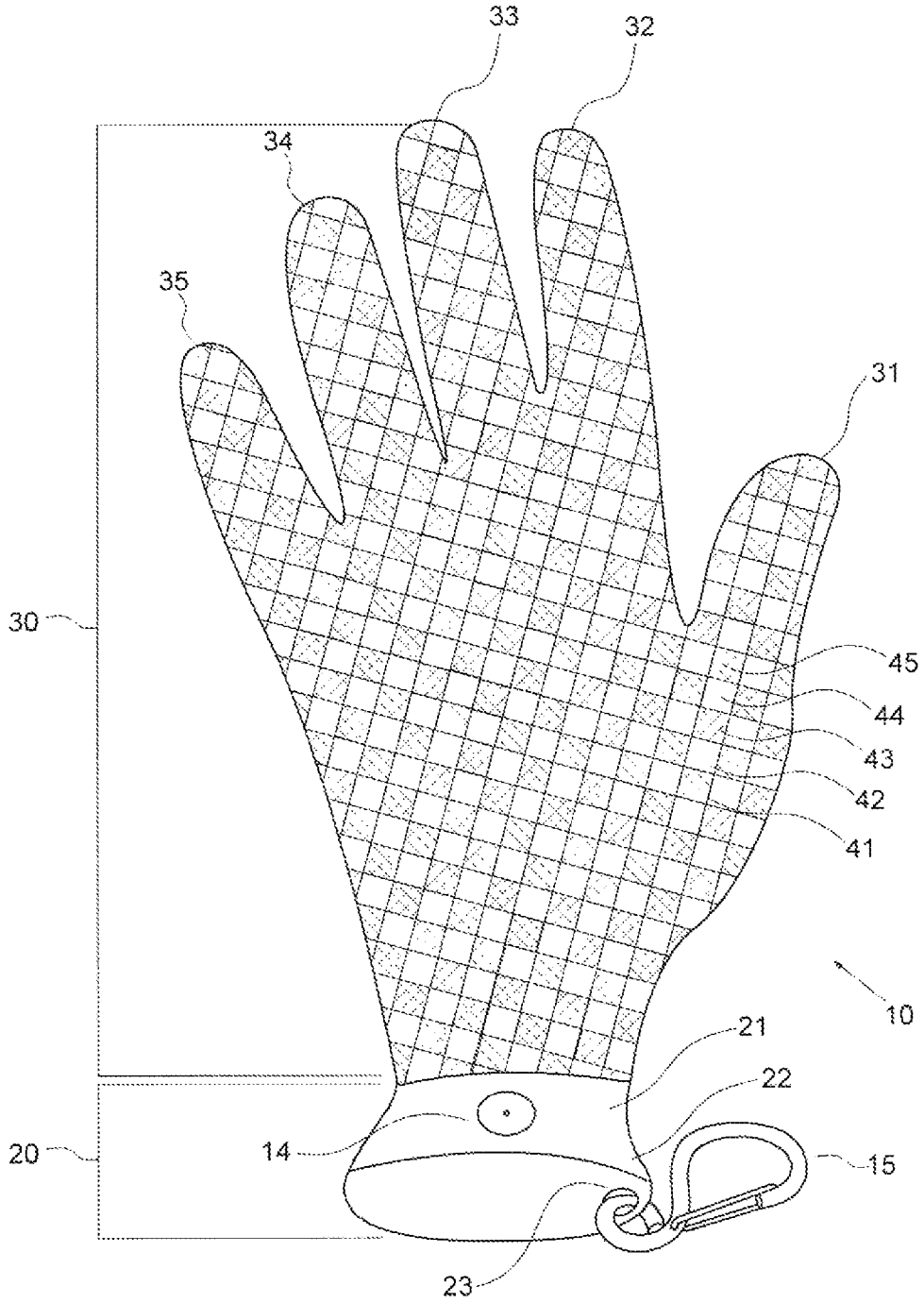
FIG. 2 illustrates a glove insert in accordance with a first embodiment of the present invention.

A glove insert 10 of the present invention is illustrated in FIG. 2. It is noted that although the glove insert 10 is shown as being formed to receive a left-handed glove thereon, a mirror image insert may similarly be formed and marketed which may instead accommodate a right-handed glove.

The glove insert 10 may broadly include a collar portion 20, and a hand portion 30 that may extend from the collar portion. The collar (and the hand portion) portion may be formed of a rigid material such as, for example, a plastic (e.g., polyvinylchloride). The collar portion 20 may alternatively be formed of a semi-rigid material, such as the smooth-cast® semi-rigid urethane casting resin available from Reynolds Advanced Materials (see, www.reynoldsam-.com/product/smooth-cast-semi-rigid/). The collar portion 20 may alternatively be made of a more flexible material, such as a natural rubber or synthetic rubber material. The collar portion 20 may be formed to be hollow, and may generally resemble the shape of a person's wrist portion, as seen in FIG. 2. The collar portion 20 may have a necked-down, narrower region 21 between the hand portion 30, and a wider portion 22 at the distal end of the collar. Alternatively, the collar may just be formed as a simple extruded oval shape.

For either embodiment, the collar may allow for visible placement of a logo or other marketing/advertising data directly thereon. The collar portion 20 may also be formed with a circular or other shaped area 14 to which a magnetic or other type of ball marker may be fastened. This may provide a further marketing opportunity whereby golf courses or other companies may place ball markers with their logos on the collar of the insert 10.

Figures 5, 6:
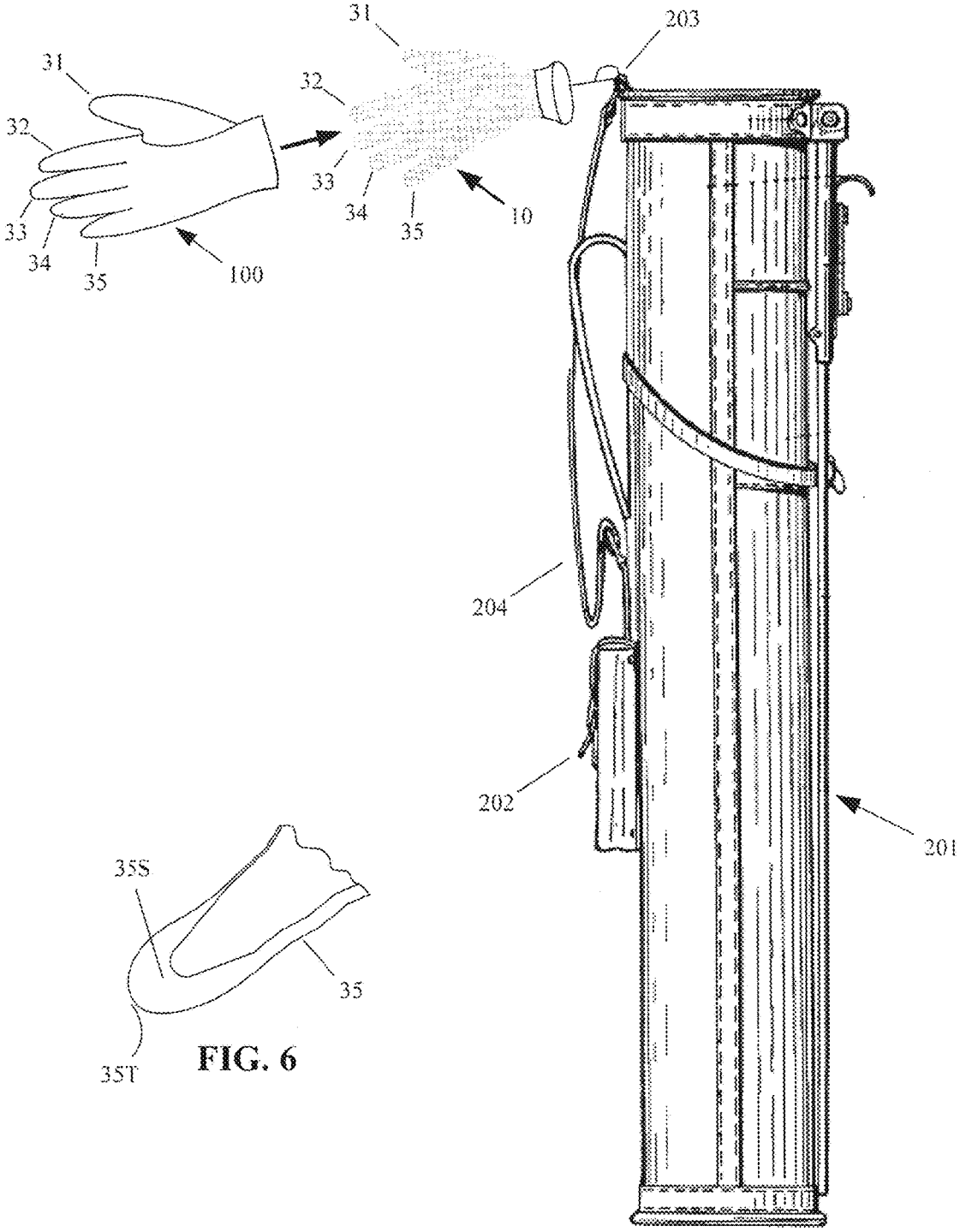
FIG. 5 illustrates the prior art golf glove of FIG. 1A just prior to being placed upon the glove insert of FIG. 2, which is shown therein releasably coupled to the prior art golf bag of FIG. 1B.
FIG. 6 illustrates is an enlarged cross-sectional view of one of the fingers of the insert of FIG. 5.

The collar portion 20 may also be formed with a hole 23, to which may be coupled a carabiner 15 (see e.g., U.S. Design Pat. No. D466,391 to Kelleghan), or other similar attachment device (e.g., a snap shackle—see U.S. Pat. No. 5,815,977 to Hill). The carabiner 15 may be used to releasably secure the glove insert 10 to a metal loop of the golf bag 201, e.g., loop 203 that is used for attachment of the bag's shoulder strap 204, as seen in FIG. 5.

The hand portion 30 may extend from the collar portion 20 to generally form a complete three-dimensional hand shape, the overall exterior size of which may be configured to correspond to standard glove sizes, and may generally be provided in each of a small, a medium, and a large size. To be more precisely adapted for use with golf gloves, the size of which is crucial for golfers, the hand portion 30 may be provided in corresponding sizes to which such golf gloves are sold, which usually includes small, medium, medium-large, large, extra-large, and double extra-large sizes, in both the regular and cadet categories. (Note that the cadet category of golf gloves tend to be wider and shorter in proportion). Use of the proper size insert with the proper size golf glove will serve to maintain its original size, which is presumably an optimal fit for the user.

The fingers 31, 32, 33, 34, and 35 of the hand portion 30 of insert 10 may preferably be formed to be spaced apart when in an un-deformed position, to provide clearance therebetween, as seen in FIG. 2. The clearance between the fingers (31, 32, 33, 34, and 35) of the glove insert 10 may assist the user in placing the corresponding fingers (101, 102, 103, 104, and 105) of the glove 100 thereon, as discussed hereinafter.

The hand portion 30 may be formed to be hollow and have a thin wall made of a semi-rigid material, and/or may have selective portions made of a flexible material, to better assist the user when trying to place the glove 100 upon the insert 10. The outer surface of the hand portion may be a smooth polished surface, which may better enable the user to place the glove onto the insert 10, and to facilitate easy removal therefrom.

It is desirable that the hand portion 30 provide three-dimensional support throughout the entire interior surface of the glove, so that it may better maintain the shape desired by the user. However, for hand portion 30 of insert 10 to provide for an increase drying capability for the glove 100, the wall of the hand portion may be perforated, being formed with a plurality of openings throughout at least a portion of its surface. To be effective at aiding in drying of the glove, the openings may preferably be formed throughout the entire surface of the hand portion: however, to nonetheless provide for three-dimensional support substantially throughout the entire interior surface of the glove 100, the plurality of openings (e.g., 41, 42, 43, 44, 45, etc.) may preferably be formed in a regularly spaced pattern. As shown in FIG. 2, the openings may be diamond shaped, however, other shaped openings may alternatively be used (e.g., circular openings, square opening, etc.).

The insert 10 being so formed may thus provide three-dimensional support substantially throughout the entire interior of the glove 100, it chiding each of its fingers and the palm/wrist region—support that may flexibly mirror the actual shape of the glove when it is worn by the golfer. In addition, the macro scale porosity created by the large openings (e.g., 41, 42, 43, 44, 45, etc.) in the hand portion 30 of glove insert 10 also serves to assist in the drying of the glove 100 after use, by allowing it to breath, and by permitting evaporation of moisture from both the exterior surface of the glove and from its interior surface.

The three-dimensional support provided by the hand portion 30 of glove insert 10 thus also simultaneously serves in maintaining the proper wearable form of the glove 100 while it dries, to prevent it from being dried and hardened in a slightly wrinkled or a completely crumpled state. Moreover, by providing such support, in which the fingers (31, 32, 33, 34, and 35) of the glove insert 10 maintain the corresponding fingers (101, 102, 103, 104, and 105) of the glove 100 spaced apart and in a flexible manner, once the glove has dried out, the user may easily apply a leather conditioner to its entire exterior surface, including the spaces between the adjacent fingers.

When the golfer is ready to begin playing a round of golf, the glove 100 may easily be removed from the insert 10. When the player finishes the round of golf and desires to place the glove 100 back onto the insert 10, he/she may simply grasp and compress the fingers (31, 32, 33, 34, and 35) of the flexible insert, which are shown spread out in FIG. 5, and slide the gathered fingers into the open end of glove 100, with its flap detached. The fingers (31, 32, 33, 34, and 35) of the flexible insert 10, once released by the person, will naturally tend to spread out within the golf glove 100, and may then be advanced forward such that each finger of the insert will be directed to the corresponding finger opening of the glove. The fingers (31, 32, 33, 34, and 35) of insert 10 will therefore need to be flexible, but also need to be stiff enough to be able to be fed into the glove's fingers without buckling appreciably. Most golf and batting gloves are fairly thin. In one embodiment of the insert 10, each of the fingers (31, 32, 33, 34, and 35) of the insert are flexible, particularly in a lateral direction, but may become increasingly stiffer with increasing distance away from the palm region (i.e., having increasing stiffness with increasing proximity to the tip of the finger). The increasing stiffness may, for example, be provided by increasing the thickness of the wall of the insert 10 with increasing proximity to the tips of the fingers. Additionally, or alternatively, one or more internal stiffeners may be provided near the tips of the fingers, which may be full depth at the fingertip (see e.g., stiffener 25S being full depth at the tip 35T of finger 35 in FIG. 6), and which stiffener may taper down towards the middle of the finger, or which may extend at a reduced height all the way to the base of the fingers, as shown for one side of the finger 35 in FIG. 6. Two such stiffeners may be used, and may be oriented at 90 degrees to each other to have a cruciform shaped cross-section near the fingertip. Thus, even if the glove 100 of the golfer had shrunk somewhat, which is not uncommon, he/she may nonetheless be able to manipulate one finger of the insert 10 at a time into the corresponding finger of the glove 100.

The hollow insert 10 may be formed by adapting a manufacturing technique known in the art for making hollow balls, in order to create the specific hollow glove shape and size(s), with the particularly spaced/positioned openings, and the thickness variations/stiffeners therein. For example, U.S. Pat. No. 1,877,673 to Law is for a "Method and Mold for Molding Hollow Rubber Articles." The '673 patent to Law teaches use of split mold halves and a spherical core that is extracted through an opening formed in the rubber ball. To form the glove insert 10 described herein, the core, may instead be shaped herein like the appropriately sized hand, and may be extracted out through the hollow collar portion 20. The hand-shaped core used herein may be sized to produce substantially constant wall thickness for the insert 10, being sized with respect to the molds. The core may also be sized to produce the variable wall thicknesses in the fingers. The spaced openings may also be formed therein using the specially adapted core and mold halves. See, U.S. Pat. No. 3,889,950 to Kasravi, U.S. Pat. No. 4,006,908 to Minarni, and U.S. Pat. No 6,003,470 to Budman. The hand-shaped core utilized herein may also be adapted to provide for forming the internal finger stiffeners.

Once the glove 100 has been placed on the insert 10, the flap of the glove can be secured across the glove's slit using the Velcro, which may serve to secure the glove on the insert at the necked-down, narrower region 21 of the collar portion 20. In addition, the collar may also have a small clip to fasten the glove 100 to the insert 10 so it does not slide off. In one embodiment, the collar 20 may additionally or alternatively have a loop 29 that may extend from the distal end of the wider portion 22 of the collar (see FIG. 4). The flap of the golf glove may be fed through the loop 29, before being secured across the slit using the Velcro, to positively secure the glove 100 to the insert 10.

The collar portion 20 may be completely open at the end opposite the glove portion 30, or alternatively, it may be closed off, and may have a pivotable door that may cover a small opening therein, when in a closed position. The small opening in the end of the collar portion 20 may permit placement of packets containing a desiccant, into the hollow of the insert 10, which may accelerate drying of the glove when necessary (e.g., between the front nine holes and the back nine holes, while the golfer may have stopped to eat lunch). For that reason, the material used to form the glove portion 30 may also be one that may wick away moisture fairly well (e.g., rayon).

Figure 3:
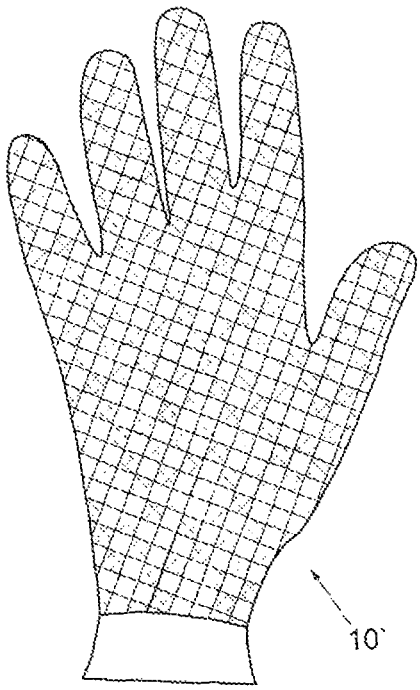
FIG. 3 illustrates a glove insert in accordance with a second embodiment of the present invention.
Figure 4:
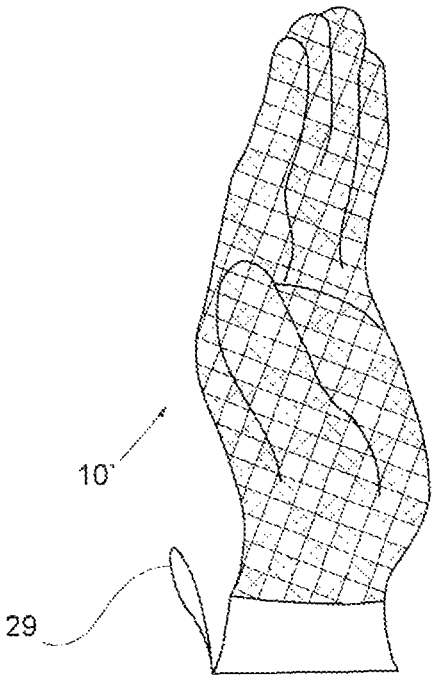
FIG. 4 illustrates a side view of the glove insert of FIG. 3.

FIGS. 3-4 illustrate a glove insert 10 that may be formed similar to glove insert 10, except that it may be woven of a suitable material. The openings in the weave may be systematically formed to generally be regularly spaced, the same as for insert 10. The glove insert 10' may be woven in the same fashion as is used for weaving baskets. (See e.g., U.S. Pat. No. 124,231 to Tower). Alternatively, the woven glove insert 10' may be formed by weaving a specific yarn in a specific manner. (See e.g., U.S. Pat. No. 6,292,948 to Chen). The yarn used may be a traditional yarn that is used for conventional fabrics, or may instead be a metallic blend yarn (e.g., stainless steel, brass, copper), or other metal yarns, which are available from Giovanna Imperia, located in Houston, Tex. Alternatively, the woven glove insert 10' may simply be made of fine or extra-fine wire, which is available from Giovanna Imperia Designs. (See. http://giovannaimperia.com/metal/wire.html). Use of the wire may furthermore permit the user to make personalized adjustments to the shape of the glove 100 supported thereon.

FIGS. 7-11 illustrate a glove device 300, the basic envelope of which may be formed in any suitable manner, including, but not limited to, an injection molding process, a casting process, a bending process, a shaping process, a coating process, etc. The glove device 300 may be formed of any suitable material, including, but not limited to, those materials discussed hereinabove with respect to the other glove device embodiments.

As seen in FIG. 7, the glove device 300 may be formed to include a palm portion 310, a finger portion 330 (i.e., for the index finger, the middle finger, the ring finger, and the pinky), and a thumb portion 340, and may also include a hanger portion 350.

The palm portion 310 may be formed with a flange 310F, having a first side, as seers in FIG. 7, and a second side, as seen in FIG. 9. In one embodiment, for ease of producing a simplified but highly functional glove insert, the flange 310F may be formed to be substantially planar. In another embodiment, the flange 310F may be formed to include a particular amount of concave curvature that may approximate the cupped shape that a person's hand may normally tend to assume, which may be a gentle cupped shape, being that a more openly held hand, or a highly cupped shape, such as when the person's thumb may touch the forefinger. In this embodiment, the cupped shape may be provided by the flange being formed with curvature, with the curvature in a first direction 310Fi being in the range of a 1.0 inch radius of curvature to 50.0 inch radius of curvature, and may also include curvature for the flange in a second direction 310Fii being in the range of a 1.0 inch radius of curvature to a 50.0 inch radius of curvature, with the second direction being generally perpendicular to the first direction.

Although the flange 310F of the palm portion 310 may have a periphery (i.e., the outer boundary seen generally in FIG. 7) that may be formed to any desired shape/outline, in one embodiment, for ease of producing a simplified but highly functional glove insert, the periphery of palm portion 310 may be formed with a first end 301 and a second end 302, each of which may be generally straight and substantially parallel. A third end 303 of the flange 310F may also be formed to be generally straight, and from which the finger portion 330 may extend, which may tend to alter the generally straight periphery of the third end 303, as discussed hereinafter. A fourth end 304 of the flange 310F may also be formed to be generally straight. Since the fourth end 304 of the flange 310F is intended to be positioned proximate to the wrist area of the glove, the fourth end 304 may instead be formed to a curved shape 304C, which may be an elliptical or other curved shape, or may be a full radius based upon the distance between the first side 301 and the second side 302.

The flange 310F of the palm portion 310 may be formed to terminate in a planar end surface. Alternatively, the flange 310F of the palm portion 310 (as well as any of the other flanges discussed herein) may be formed to terminate in a curved surface, which may be a radiused surface having a radius of curvature Ri (sec FIG. 8) that may be equal to the thickness T of the flange at that location (i.e., a full radius).

The finger portion 330 may include a first flange 331 that may be used for supporting the index finger of the glove, a second flange 332 that may be used for supporting the middle finger of the glove, a third flange 333 that may be used for supporting the ring finger of the glove, and a fourth flange 334 that may be used for supporting the pinky finger of the glove. The first flange 331 may extend away from the third end 303 of the flange 310F, and one (lateral) end of the first flange 331 may be aligned with the first end 301 of flange 310F. The fourth flange 334 may extend away from the third end 303 of the flange 310F, and one (lateral) end of the fourth flange 334 may be aligned with the second end 302 of flange 310F. The second flange 332 and the third flange 333 may similarly extend away from the third end 303 of the flange 310F, and may be equally spaced between the first flange 331 and the fourth flange 334.

Although various different lengths may be used for each of the finger flanges 331, 332, 333, and 334, in one embodiment the lengths used may correspond to typical finger lengths, and thus the second flange 332 for the middle finger may be the longest, the third flange 333 for the ring finger may be the next longest, the first flange 331 for the index finger may be the third longest, and the fourth flange 334 for the pinky finger may be the shortest of the finger flanges. The widths for each of the finger flanges 331, 332, 333, and 334 may be the same, or may be different. The distal end of each of the finger flanges 331, 332, 333, and 334, being distal from the connection with the third end 303 of flange 310F, may be rounded, and may be radiused using a corresponding full radius based on the width of the flange (i.e., R31, R32, R33, and R34). The lengths of the finger flanges, as well as various other aspects of the glove device 300 may be proportionately formed to correspond to golf glove sizes, which usually includes small, medium, medium-large, large, extra-large, and double extra-large sizes, in both the regular and cadet categories.

In one embodiment, for ease of producing a simplified but highly functional glove device 300, the finger flanges 331, 332, 333, and 334 may each be formed to be substantially coplanar with each other, and may additionally be formed to be coplanar with the flange 310F. In another embodiment, as seen in FIG. 8, the finger flanges 331, 332, 333, and 334 may each be formed to extend away from the third end 303 of flange 310F, and be tangent thereto, but may also be formed with curvature, which may be the same curvature for each of the finger flanges, and may be in the range of a 1.0 inch radius of curvature to 50.0 inch radius of curvature. Alternatively, each of the finger flanges 331, 332, 333, and 334 may be formed with various different amounts of curvature. Also, the connection of the middle finger flange 332 to the flange 310F lay be radiused with respect to the first finger flange 331 using radius R3132, and may also be radiused with respect to the ring finger flange 333 using radius R3233. The ring finger flange 333 may be radiused with respect to the fourth finger flange 334 using radius R3334. Note that the use of radii R3132, R3233, and R3334 may eliminate the actual visible appearance of any portions of the straight end 303 of the flange 310F.

Figure 7B:
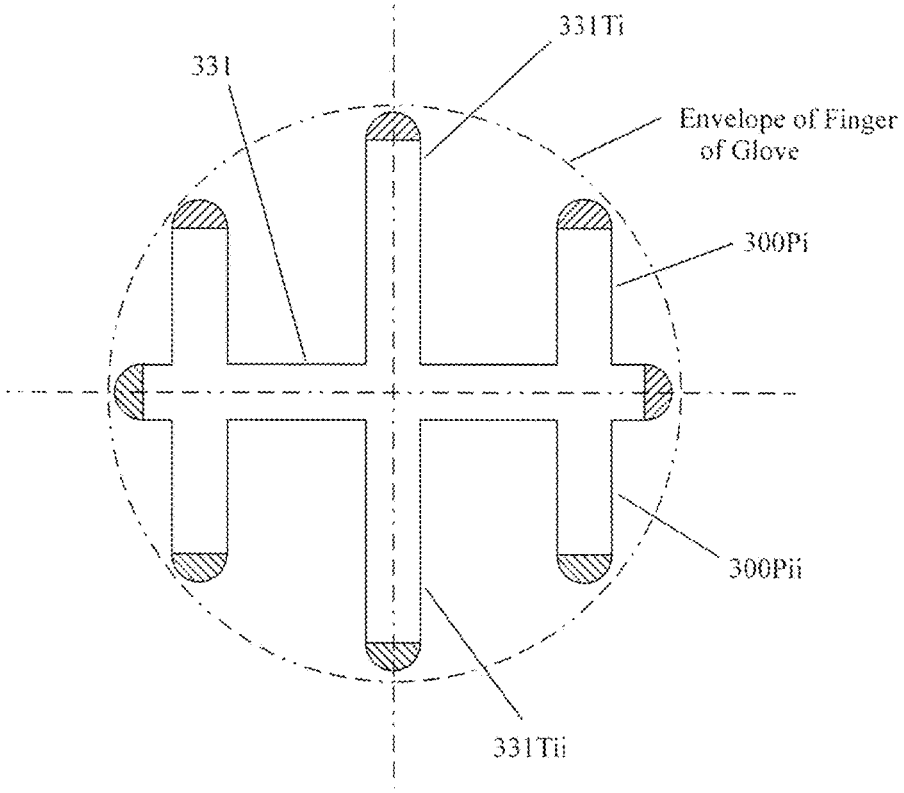
FIG. 7 illustrates front view of a glove device in accordance with another embodiment of the present invention.
FIG. 7A is a cross-section view through one of the finger support regions of the device of FIG. 7.

The flange 310F of the palm portion 310 may be sized, shaped, and positioned to substantially occupy a "mid-plane" of the palm portion of the particularly sized golf glove, Similarly, each of the finger flanges 331, 332, 333, and 334 of the finger portion 330 may be positioned to be at a central "mid-plane" position of the respective finger of the golf glove, as seen in the cross-sectional view in FIG. 7A, and the enlarged version of that view in FIG. 7B. The term mid-plane is used loosely with respect to the fingers, because where curvature is used for the finger flanges 331, 332, 333, and 334, each flange would not have a planar central axis, and in that case use of the term "mid-plane" means that the center of the flange at each point along the axis of the finger would nonetheless be substantially centered therein.

Each side of each of the finger flanges 331, 332, 333, and 334 may have a respective transverse flange (331Ti/331Tii, 332Ti/332Tii, 333Ti/333Tii, 334Ti/334Tii) protruding therefrom, and being centrally positioned on the finger flange. Each of the respective transverse flanges (331Ti/331Tii, 332Ti/332Tii, 333ti/333Tii, 334Ti/334Tii) may terminate before reaching the end of the finger flange, and may be radiused with a radius $R_T$, as it so terminates, as seen in FIG. 8. Also, as seen in FIG. 7A and FIG. 7B, each of the finger flanges and the respective transverse flanges may form a cruciform cross-sectional shape. In one embodiment, each of the centrally positioned transverse flanges (331Ti/331Tii, 332Ti/332Tii, 333Ti/333Tii, 334Ti/334Tii) may extend for the length of the respective finger flange. In another embodiment the centrally positioned transverse flanges (331Ti/331Tii, 334Ti/334Tii) for the first and fourth finger flanges 331/334 may each extend all the way to the palm portion 310, and upon approaching its fourth end 304, each may follow the peripheral outline of the palm portion (e.g., square or curved), and be interconnected thereat to form a single flange. Also, the centrally positioned transverse flanges 331Ti/331Tii, 334Ti/334Tii) for the first and fourth finger flanges 331/334 may each extend all the way to the palm portion 310, and upon approaching its fourth end 304, each may follow the peripheral outline of the palm portion e.g., it may follow a square track or the curved track 3134Pi shown in FIG. 7), and may be interconnected thereat to form a single flange. Similarly, the centrally positioned transverse flanges (332Ti/332Tii, 333Ti/333Tii) for the second and third finger flanges 332/333 may each, extend all the way to the palm portion 310, and may also be interconnected threat to form a single flange at 3233Pi, The centrally positioned transverse flanges (332Ti/332Tii, 333Ti/333Tii) for the second and third finger flanges 332/333 may also follow a track that may be curved in the palm region at 332Bi and 331BI, which may leave an open circular-shaped region on the flange 310F, upon which may be stenciled, or may have formed thereon in raised lettering/symbols a company name/logo, which may be used for marketing purposes.

Each side of the palm region 310 and the finger flanges 331, 332, 333, and 334 may also have a continuous peripherally-located flange 300Pi/300Pii that may extend substantially perpendicularly, as seen in FIG. 7A and FIG. 7B. The flanges 300Pi/300Pii may be positioned in proximity to, and may follow the outline of, the periphery formed by the combination of the palm region 310 and the finger flanges 331, 332, 333, and 334 of the finger region 330, but may be slightly displaced therefrom, as seen in FIG. 7B. Therefore, these built up radiused flanges, as shown in FIG. 7B, may form a distributed frame work with eight radiused points of contact to provide support for each finger of the glove better maintain the form of the fingers, while also serving to maximize the open interior area to encourage drying. The flanges in the palm region 310 may similarly serve to support the corresponding portion of the glove. It should be noted that although it is not shown in FIG. 7B, the joining of the flanges may include use of a fillet radius, which may be required for certain forming operations, partitularly injection molding. Also, the flanges may be formed with draft, rather than being substantially parallel.

Each of the tips of the flanges (see hatched regions in FIG. 7B) may be coated with a particular material that may serve to provide a low coefficient of friction with respect to a material of the golf glove, to permit easy insertion of the device into the glove. Teflon has a low coefficient of friction, and generally permits low friction sliding between two members. Certain wood materials have a low static coefficient of friction (i.e. 0.3 to 0.4) with respect to leather.

The thumb portion 340 may be formed with a flange that may extend away from the flange 310F of the palm portion 310. A first flange portion 340Fi of the thumb portion 340 may be curved, and may be tangent to the flange 310F of the palm portion 310. A second flange portion 340Fii of the thumb portion 340 may be planar, and may extend away from the first flange portion 310Fi. In one embodiment, the planar second flange portion 340Fii of the thumb portion 340 may have a flange 340P protruding transversely from each side, each of which may be formed into an elongated racetrack shape, and which may also have a centrally positioned transverse flange 340T protruding perpendicularly therefrom. In another embodiment, only one side of the planar second flange portion 340Fii may have a racetrack-shaped flange 340P protruding transversely therefrom, with a centrally positioned transverse flange 340T protruding perpendicularly. The other side may have an elongated dome shape 340D formed thereon, as shown in FIG. 7. Each of these embodiments may serve to provide support for the thumb of the glove. Also, each of these embodiments may have a plurality of small holes in the palm portion and/or the fingers flanges to permit airflow from one side of the device to the other side.

The hanger portion 350 may be formed by extending portion of the flange 310F, which may resemble the width of a person's wrist as seen in FIG. 7 and FIG. 8. The hanger portion 350 may be formed with an orifice for mounting of a lanyard thereto, or for hanging the device 300 on a hook. At the distal end of the hanger portion 350 may be formed flange 351 to prevent tear-out as a result of the orifice being used to hold the device and the glove.

While illustrative implementations of one or more embodiments of the present invention are provided hereinabove, those skilled in art and having the benefit of the present disclosure w ill appreciate that further embodiments may be implemented with various changes within the scope of the present invention. Other modifications, substitutions, omissions and changes may be made in the design, size, materials used or proportions, operating conditions, assembly sequence, or arrangement or positioning of elements and members of the exemplary embodiments without departing from the spirit of this invention.

Accordingly, the breadth of the present disclosure should not be limited by any of the above-described example embodiments, but should be defined only in accordance with the following claims and their equivalents.

What is claimed is:

1. A device for substantially maintaining the full form of a glove while facilitating drying of the glove, said device comprising a hand-shaped form having:

a palm portion comprising a substantially planar flange having a first side and a second side; and a plurality of finger flanges comprising: an index finger flange, a middle finger flange, a ring finger flange, and a pinky finger flange; each of said finger flanges configured to extend from said first end of said substantially planar flange of said palm portion;

a first peripheral flange configured to extend away from and be in continuous proximity to, a periphery formed by said first side of said palm portion and said plurality of finger flanges;

a second peripheral flange configured to extend away from and be in continuous proximity to, a periphery formed by said second side of said palm portion and said plurality of finger flanges;

a first transverse flange for each of said finger flanges, each configured to extend away from a first side thereof, and to be substantially centered on the finger flange;

a second transverse flange for each of said finger flanges, each configure to extend away from a first side thereof, and to be substantially centered on the finger flange; and a thumb portion.

2. The device according to claim 1, wherein an end of each said flange is radiused; and wherein each of said peripheral flanges and transverse flanges on each said finger flange form a distributed frame work with eight radiused points of contact being substantially equally spaced to provide support for each finger of the glove.

3. The device according to claim 1 further comprising a coating applied to a tip portion of an entire periphery of each said flange, said coating configured to provide a low coefficient of friction with respect to a material of the glove, to permit easy insertion of the device into the glove.

4. The device according to claim 1, wherein each said finger flange is planar.

5. The device according to claim 1, wherein each said finger flange comprises curvature.

6. The device according to claim 4, wherein said finger flange comprises curvature in a first direction, and curvature in a second direction, said second direction being perpendicular to said first direction.

7. The device according to claim 5, wherein said curvature comprises a radius of curvature in the range of a 1.0 inch radius of curvature to 50.0 inch radius of curvature.

8. The device according to claim 1, wherein said first transverse flange for said index finger flange and said first transverse flange for said pinky finger flange each extend around said palm portion and are thereat interconnected: and wherein said second transverse flange for said index finger flange and said second transverse flange for said pinky finger flange each extend around said palm portion and are thereat interconnected.

9. The device according to claim 7, wherein said first transverse flange for said middle finger flange and said first transverse flange for said ring finger flange each extend around said palm portion and are thereat interconnected; and wherein said second transverse flange for said middle finger flange and said second transverse flange for said ring finger flange each extend around said palm portion and are thereat interconnected.

* * * * *